US005134809A

United States Patent [19]

Morton et al.

[11] Patent Number: 5,134,809

[45] Date of Patent: Aug. 4, 1992

[54] SANDING APPARATUS AND METHOD OF MAKING AND USING THE SAME

[76] Inventors: Barney Morton, 4547 Underwood Road, North Vancouver, B.C., Canada, V7K 2S3; Robert Smith, 2305 Victoria, Vancouver, B.C., Canada

[21] Appl. No.: 535,377

[22] Filed: Jun. 7, 1990

[51] Int. Cl.[5] ..... B24D 15/00

[52] U.S. Cl. ..... 51/391; 51/401; 51/407

[58] Field of Search ..... 2/161 A, 164, 168, 169; 51/391, 407, 401, 394

[56] References Cited

U.S. PATENT DOCUMENTS

| | | | |
|---|---|---|---|
| 1,782,577 | 8/1928 | Maris . | |
| 2,046,240 | 7/1932 | Bayley . | |
| 3,151,333 | 11/1964 | Scholz . | |
| 3,540,160 | 1/1967 | De Rose et al. . | |
| 3,643,386 | 2/1972 | Grzyll . | |
| 3,748,792 | 7/1973 | Lamb . | |
| 3,789,555 | 2/1974 | Means . | |
| 3,885,249 | 5/1975 | De Brabander . | |
| 4,038,787 | 8/1977 | Bianchi . | |
| 4,107,840 | 8/1978 | Kupperman et al. . | |
| 4,263,677 | 4/1981 | Menser . | |
| 4,316,926 | 2/1982 | Kaminstein | 2/169 |
| 4,593,427 | 6/1986 | Ortolivo . | |

FOREIGN PATENT DOCUMENTS

| | | | |
|---|---|---|---|
| 399117 | 9/1933 | United Kingdom | 51/391 |

*Primary Examiner*—M. Rachuba
*Attorney, Agent, or Firm*—Hughes & Multer

[57] ABSTRACT

An apparatus to be retained on a person's hand while being used to perform a sanding operation. The apparatus comprises a first lower abrasive layer having a downwardly facing abrasive surface, a second structural layer, and a third retaining layer. The retaining layer is to be fastened by a fastening connection formed of a meltable material to a portion of the second layer. The second and third layers define a hand receiving portion. The third layer stretches to allow the apparatus to be used to abrade curved work surfaces.

15 Claims, 7 Drawing Sheets

SANDING APPARATUS AND METHOD OF MAKING AND USING THE SAME

BACKGROUND OF THE INVENTION

The present invention relates generally to a sanding apparatus and methods of making and using the same, and more particularly to a sanding apparatus and method where the apparatus is retained on the person's hand.

BACKGROUND ART

Various handheld and hand-retained sanding apparatus are known. For example, there are various gloves, mittens, sanding blocks, hollow sponge devices and the like, that are covered with an abrasive substance such as sand and are retained on the person's hand. There is a sponge mitt which is covered with an abrasive surface material. There is an abrasive band which partially encloses the person's hand. Furthermore, some of these are water immersible.

However, there remains a need for a sanding apparatus that is used by the person with minimal effort, and which is able to be manufactured by automatic means with as few steps as possible.

SUMMARY OF THE INVENTION

The invention is directed at a sanding apparatus and method, using at least two layers. These are a first lower layer having a downwardly facing abrasive surface and a second structural layer. The structural layer has a lower surface and an upper surface, with the first layer being attached to the lower surface of the second layer.

The first and second layers cooperate to provide structural support. The upper surface of the second layer is engaged by a person's hand for application of a downward force thereon. The lower surface of the second layer is planar and has a perimeter at least substantially coextensive with the periphery of the person's hand. The second layer has a structural configuration such that upon application of a downward force and with the apparatus applied to a work surface, the lower surface of the second layer and the first layer remain substantially planar and in substantial abrasive pressing engagement with the work surface over a substantial portion of the lower surface.

The apparatus further comprises a third retaining layer. The third layer is to be fastened by a fastening connection formed of a meltable material to a portion of the second layer. The second and third layers define a hand receiving area. The meltable material is adapted to be melted by heat and resolidified so that at room temperature the meltable material forms the fastening connection.

BRIEF DESCRIPTION OF THE DRAWINGS

FIG. 6*a* is to be superimposed on FIG. 6*b;*

DESCRIPTION OF THE PREFERRED EMBODIMENT

It is believed that a better understanding of the present invention will be provided by describing the components, operation, and method of manufacturing a first embodiment of the present invention. This will be followed by a description of other embodiments and of further technical details.

1. The Components of a First Embodiment of a Sanding Device. Before turning to the components, for ease of orientation let us refer to FIG. 1 which shows a person's hand 10 positioned within a first embodiment 12 of sanding apparatus of the present invention. The first embodiment 12 is adapted to be applied by the person directly to a planar work surface 14 such as drywall or sheetrock for a sanding operation. The terms "up", "upper", "upward" and the like will have reference to the upward direction indicated by the arrow 16 in FIG. 1; while the terms "down", "lower", and "downward" will denote the opposite.

Figure 3:
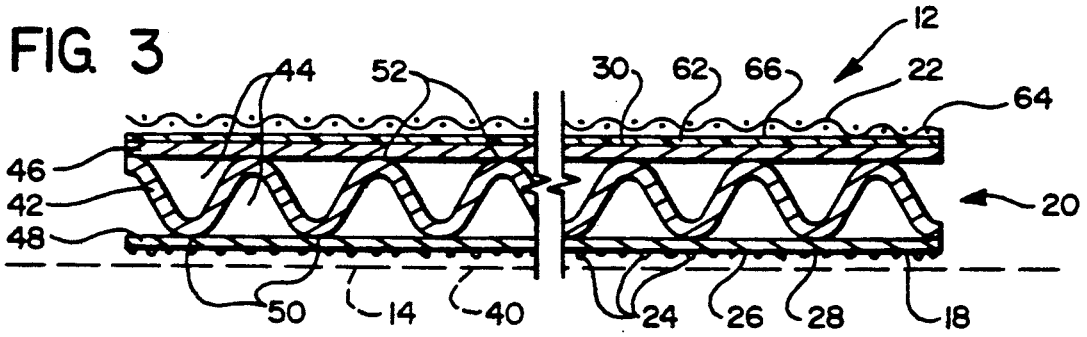
FIG. 3 is a cross section taken along the line 3—3 of FIG. 2.

Turning now to the cross section of the apparatus FIG. 3 the sanding apparatus 12 comprises three basic uniform layers: a lower abrasive layer 18, a middle structural layer 20, and an upper retaining layer 22. The abrasive layer 18 comprises abrasive particles 24 which form a downwardly facing abrasive surface 26 adapted to be pressed in abrasive engagement with the work surface 14. The structural layer 20 comprises a lower structural surface 28 which attaches to the abrasive layer 18 and an upper structural surface 30 adapted to receive the downward pressing force of the person's hand. The retaining layer 22 (which appears web-like in FIG. 1) is fastened at peripheral edges 32, 34 and 36 to the structural layer 20 and deflects upwardly to define with the structural layer 20 a hand receiving area or pocket 38 into which the person's hand fits.

As shown in FIG. 3 the structural layer 20 has a structural configuration such that upon being forced downwardly against the work surface 14, the structural layer 20 is able to maintain its lower surface 28 and the abrasive layer 18 in substantially one working plane 40. Even upon the application of uneven lateral forces during sanding, which may be unevenly distributed within the structural layer 20, the structural layer 20 is able to hold the abrasive layer 18 planar. In the first embodiment the structural material used to illustrate the preferred structural properties is corrugated paper. The corrugated paper comprises a series of curved V-shaped portions or corrugations 42, these curved portions 42 defining parallel flutes 44 and being substantially uniform throughout the structural layer 20. Cooperating to form a rigid structure are the curved portions 42, an upper paper sub-layer 46, and a lower paper sub-layer 48 to which the curved portions 42 are attached at 50 and 52. While corrugated paper is the preferred material for the structural layer 20, similar results are able to be achieved by substituting other corrugated materials or open or closed cellular materials, under such circumstances where such materials inherently or when laminated to the abrasive layer 18 will furnish sufficient rigidity.

Figure 1:
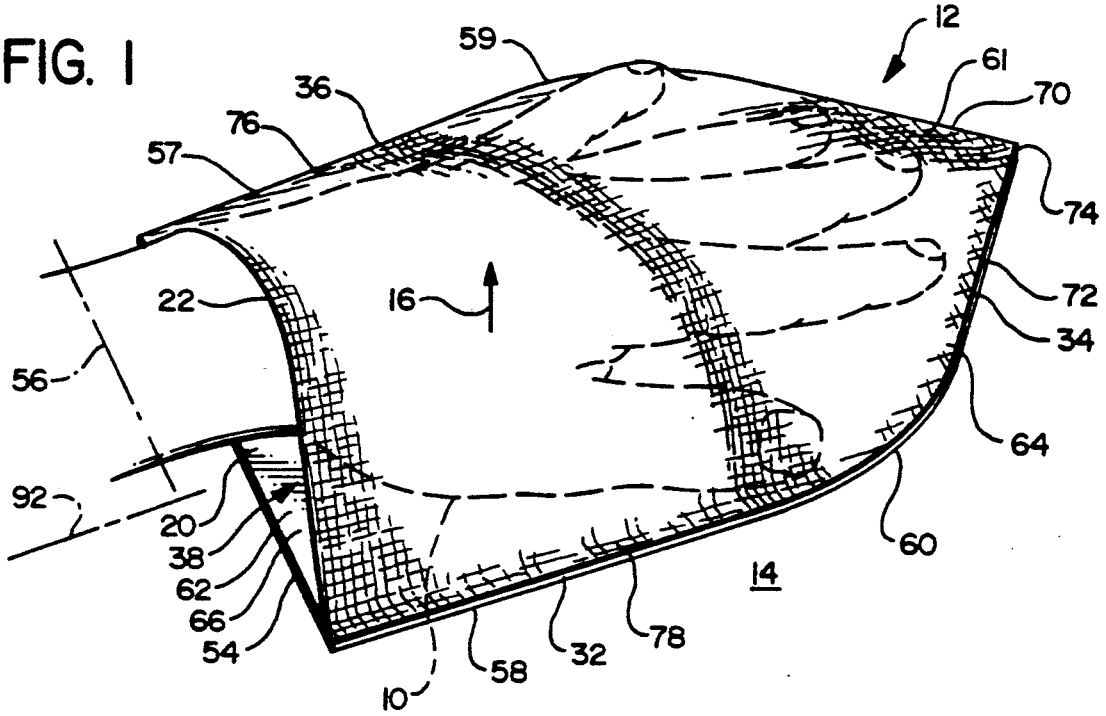
FIG. 1 is a perspective view of a first embodiment of the apparatus of the present invention.

As is evident in FIG. 1 each of the layers 18, 20, and 22 are generally congruent and co-extensive with a periphery of the person's hand. Consistent with this congruence the sanding apparatus 12 defines overall a straight base 54 parallel to a cross-wise axis 56, and left and right forwardly outwardly slanted tapered sides 57 and 58, respectively, which curve inwardly at 59 and 60 to a narrow pointed portion 61 which will be described shortly herein.

There is used in the present invention as indicated in FIGS. 1 and 3 a measured quantity of a hot-melt material, such as for example, polyethylene or a modified polyolefin 62. In the present invention the hot-melt material 62 serves dual functions: it both (i) forms a fastening strip 64 between the structural and retaining layers 20 and 22, and (ii) forms on the upper structural surface 30 in a solidified state a hand engaging semi-adhesive surface 66, which tends to adhere upon contact to the person's hand but which is removeable at will from the person's hand.

2. Operation and Additional Features. In operation, the person merely slips the person's hand into the pocket 38 where the hand will be comfortably sandwiched between the retaining layer 22 and the structural layer 20. When the person begins pressing downwardly so as to press the abrasive surface 26 against the work surface 14, the structural layer 20 will remain rigid. Assuming that the person begins to employ a repetitive sanding motion that exerts lateral pressures on the structural layer 20 (such as movement side-to-side along the crosswise axis 56) the structural layer 26 will keep the abrasive surface 26 substantially planar, and substantially all of the abrasive surface 14 will remain in continuous pressing abrasive engagement with the work surface 14. The sanding apparatus is retained on the person's hand by the retaining layer 22 holding the palm of the person's hand against the device and by the semi-adhesive surface 66 adhering to the palm of the hand.

Figure 2:
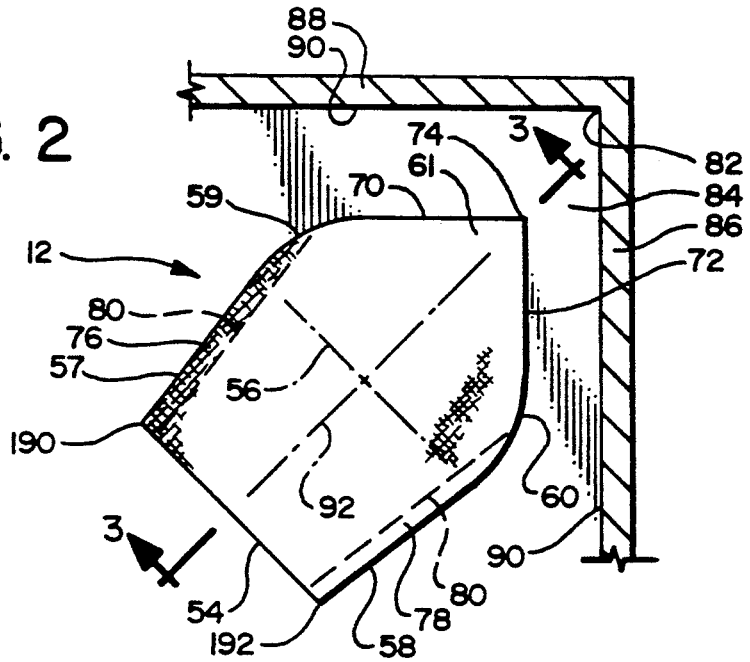
FIG. 2 is a top view of a first embodiment.

To discuss an additional aspect of the apparatus, the narrow front portion 61 comprises a left straight edge 70 and a right straight edge 72 which come together in essentially a right angle at a point or corner 74 so that the straight edges are at 45° to a lengthwise axis. The straight edges 70 and 72, being supported by the rigid structural configuration of the structural layer 20, are themselves rigid. The apparatus also has at 76 and 78, respectively, left and right rearward flexible margins extending for a width, such as ½ inch, from the periphery of the sanding apparatus to a dashed line designated 80. To become flexible, the flexible margins 76 and 78 have received a treatment which is described later in connection with manufacture. As shown in FIG. 2, the corner 74 enables the person using the apparatus to sand portions of the working surface 14 that are very close to a work corner here illustrated as a location 82 where adjoining walls 84 and 86 and a ceiling 88 of a room meet. The corner 74 enables the apparatus to also reach similar spots within cabinets, window sashes and the like. The straight edges 70 and 72 similarly help to assure uniform sanding along cornering lines 90.

Let's examine now a situation where the working surface 14 while being essentially planar, contains irregularities and imperfections such as a sudden bump. To approach the bump, rather than using a lengthwise thrust, (i.e., along a lengthwise axis 92 of the sanding apparatus) which would push the rigid edges 70 and 72 over the bump so as to risk both poor sanding and extra stress upon the edges 70 and 72, the person is able to move side to side along the cross-wise axis 56 whereby the flexible margins 76 and 78 are presented to the bump. These margins 76 and 78 ride flexibly over the bump.

Let us, before turning to manufacturing considerations, summarize the main features discussed so far of the first embodiment.

First, the combining of the structural layer 20 with the abrasive and retaining layers 18 and 22 keeps the abrasive layer 18 planar notwithstanding the variety of directions from where pressures may be applied. This rigidity brings substantially all of the abrasive surface 26 into continual pressing abrasive engagement with the work, whereby the wear of the abrasive surface 26 is highly uniform. Second, the person is able to achieve this uniformity of sanding while still employing a variety of hand motions (i.e. side to side, forward and back, circular, etc). Also the person is able to concentrate on applying friction to the work without need to use the strength of the person's hand to retain the apparatus on the hand. Consequently, fatigue is reduced. Third, the apparatus is adapted to sand close to corners and edges which require rigidity of the device, while also being able to sand irregularities where the device rides over these. The positioning of the corner 74 in the middle and in front of the person's hand provides improved control for corner sanding. Finally, while being rigid, the materials of the first embodiment are disposable so that the unit may be discarded when the abrasive surface becomes worn.

Figure 4:
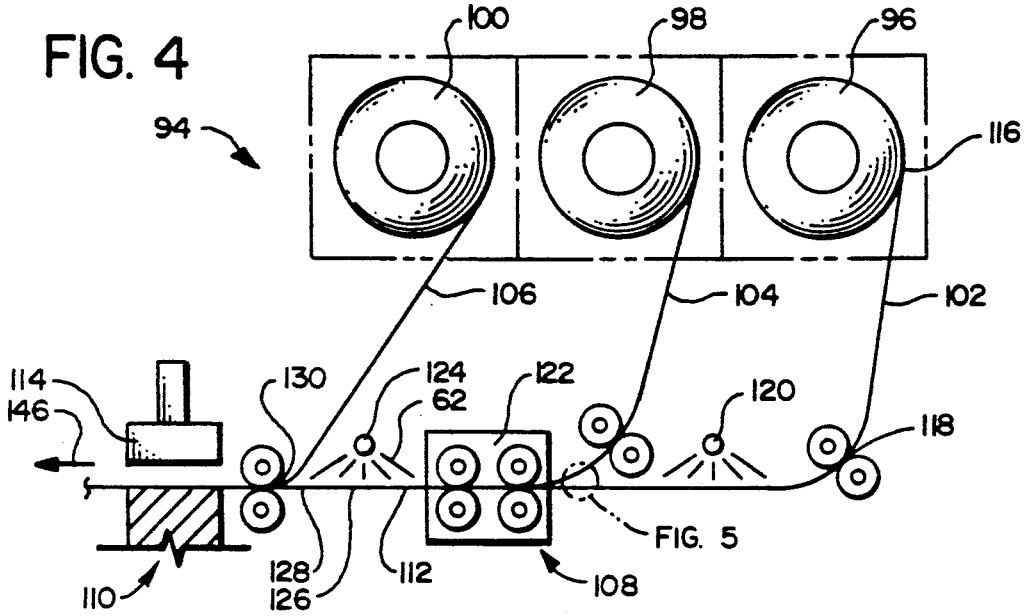
FIG. 4 is a schematic view of a manufacturing installation of the present invention for manufacturing the sanding apparatus of the present invention.

3. Manufacture. In FIG. 4 there is shown an installation 94 for making the apparatus 12 of the present invention. The major components of the installation 94 are rotatable rolls 96, 98, and 100 containing, in order, strips of sandpaper 102, a substrate 104, and a retaining material 106 all in roll form; an intermediate joining location 108; and a fastening/cutting location 110. The intermediate joining location 108 is where the sandpaper strip 102, which is facing downwardly, and the substrate strip 104 become laminated to one another to form a laminate strip 112. At the fastening/cutting location 110 the laminate 112 strip and the retaining strip 106 which is atop the laminate strip undergo a cutting/fastening/-pressing operation performed by a combination tool or group of tools 114.

To elaborate, the sandpaper strip 102 is fed at 116 to 118 where the strip 102 levels off, and then continues beneath an adhesive applicator 120 which coats the back of the sandpaper strip 102 with an adhesive. The substrate strip 104 is fed from the substrate roll 98 to the intermediate joining location 108 where press rollers 122 complete the lamination of the sandpaper and substrate. The resulting laminate strip 112 continues beneath a hot-melt applicator 124 which coats the top of the substrate strip 104 with the hot-melt material 62. As the laminate strip 112 continues through the points 126 and 128 the hot-melt material 62 is allowed to cool and solidify. The retaining strip 106 from the retaining roller 100 is stacked atop the laminate strip 112 (with the solidified hot-melt material) at 130 from the where the stacked laminate strip 112 and retaining strip 106 enter the fastening/cutting location 110.

Let us examine further the three simultaneous operations of the combination tool 114, starting with the fastening task. At a location 13 on the line "XXX" seen in the schematic top view of the sanding apparatus 12 of FIG. 6 where the straight edges 70 and 72 are to be formed, the combination tool 114 (turning now to FIG. 7 in cross section) includes a heater 132 which is spring loaded downwardly and also moveable up and down on a support 134. At the moment of fastening, the heater 132, which is heated to perhaps 120°-130° C., is moved from its upper position of FIG. *7a* to its lowered position of FIG. *7b* where it comes into relatively soft contact with the retaining material 106 and with the hot-melt material 62 beneath, which immediately remelts. After the liquified hot-melt material 62 has impregnated both the substrate strip 104 below it and the retaining material 106 above it and once the heater 132 has been lifted as shown in FIG. *7c*, the hot-melt material resolidifies to form the solid fastening strip 64 between the structural and retaining layers 20 and 22 that was earlier alluded to. The remaining portion of the hot-melt material 132 which coats the substrate strip 104 is not affected by the heater 62 during the step described; this portion of the hot-melt material 62 simply remains in place to form the semi-adhesive surface 66. The plan configuration of the heater 132 can be seen in the heater plan 135 of FIG. 6.

Figure 6A:
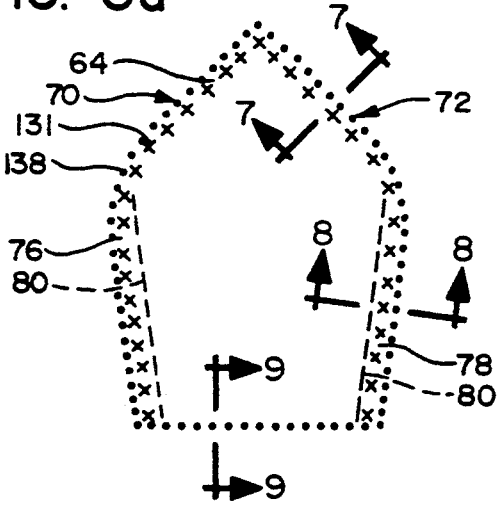
FIGS. 6*a* and *b* are two schematic views from the top showing the position of various elements of a combination tool used in manufacturing. The diagram on the left marked "a" shows a plan configuration of a cutting die and of a hot-melt fastening strip; the diagram on the right marked "b" shows a plan configuration of a heater element and of a press heater element; in the actual combination tool.
Figure 6B:
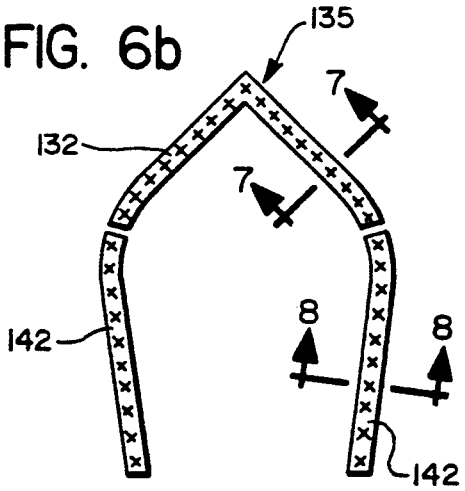

The cutting operation is simply performed by a cutting die 136 (seen in FIG. 7) of hardened steel along the dotted line 138 in FIG. 6. The die 136 is also part of the combination tool 114 and is shaped in the outline 138 of the sanding apparatus 12.

Figure 5:
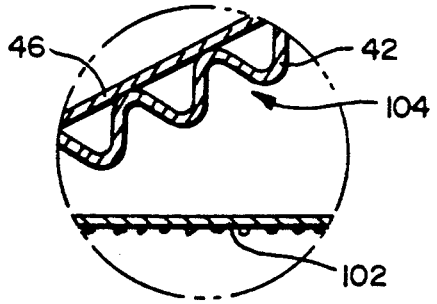
FIG. 5 is an enlarged view taken from the dotted circle marked 5 in FIG. 4 where a corrugated strip and a sandpaper strip come together in manufacturing.

Finally in this same step, in order to illustrate how the flexible margins 76 and 78 of the sanding apparatus 12 are able to be formed, let us make the assumption that the substrate strip 104 as shown in the enlargement of FIG. 5 comprises half open corrugated paper comprising the upper sub-layer or backing 46 and the curved portions or corrugations 42. With this premise in mind it is apparent that underneath the combination tool 114 as seen in FIG. 8 a sandwich 140 is formed that comprises the stack of the sandpaper strip 102, the corrugations 42, the backing 46, the hot-melt material 62, and the retaining strip 106. The layer of hot-melt material 62 at the margins 76 and 78 should be sufficiently thin so as to allow the margins 76 and 78 to be flexible. At this location there is no spring loaded version of the heater. Instead there is a press-heater 142 that has an outwardly downwardly sloping bottom surface 144. At the instant of cutting, the bottom surface 144 of the press-heater 142 presses down on the edge of the sandwich 140, applying at the same time heat to melt the hot-melt material 62 and also a downward pressing force to press the sandwich 140, and in particular, the corrugations 42 permanently into a flat shape (FIG. *8c*). When the press-heater 142 is lifted the margin 78 in the picture remains crushed. The margin 78 no longer contains the rigid corrugation 42, but instead is flexible. (Preferably there is also produced a slight upward curl or curve at the underneath edge at 145, to enable the margins 76 nd 78 to ride better over bumps. In contrast, as shown in FIG. *7c* the sandwich 140 which is located at the straight edges 70 and 72 is not crushed and therefore at this location remains rigid. Also, at the rear of the sanding device 12 as shown in the cross-section of FIG. 9 only the cutting die 136 is applied (neither the heater 132 nor the press-heater 142 are applied); accordingly the sandwich 140 here is not crushed and also remains rigid.

Returning to FIG. 4 after the final cutting and fastening are done, the individual sanding apparatus 12 is moved to a packing location indicated by the arrow 146, while the wastage is separated therefrom.

As a variation of the downward crushing of the corrugated substrate in FIGS. *8a-c*, the flexible margins 76 and 78 are formed to curve upwardly to enhance the riding of the margins 76 and 78 over bumps. This is done possibly by crushing he substrate from underneath to curve outwardly upwardly.

Figure 10:
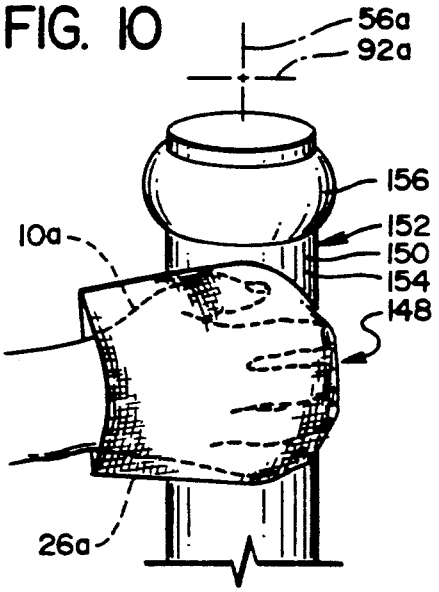
FIG. 10 is a view of the second embodiment of apparatus of the present invention in use.

4. A Second Embodiment Which is Flexible. FIG. 10 shows a second embodiment 148 of the inventive sanding apparatus wherein components that are like those of the first embodiment will have the same numerical designations with a suffix "a". The second embodiment 148 contains all the components and features of the first embodiment except that the second embodiment 148 is adapted to be used on a curved work surface 150 such as the exterior of a wooden dowel 152. Such a curved work surface 150 may consist of a simple curve such as at 154, or more complex curves such as at the wavy lathe work 156.

In terms of physical flexibility, on the one hand the second embodiment 148 is sufficiently flexible relative to both its lengthwise axis 92a and crosswise axis 56a so as to enable the person to bring an abrasive surface 26a of the device into pressing abrasive engagement with the curved work surface 150. On the other hand, the second embodiment 148 is sufficiently resilient to support the person's hand 10a and distribute the pressure evenly to the work surface 150.

Figure 12:
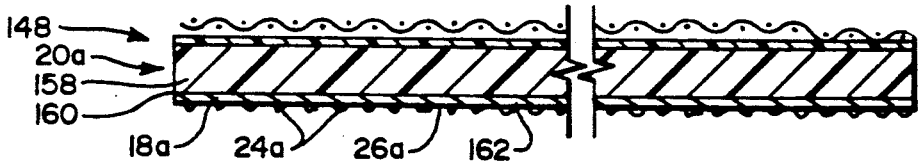
FIG. 12 is a cross section taken along the line 12—12 in FIG. 11.

To achieve this difference in the second embodiment as compared to the first embodiment, a different structural layer 20a is employed. As shown in FIG. 12 an example of such a structural layer 20a comprises a substrate 158 of open or close cell polymer foam which is laminated at 160 to a smooth side of sandpaper 18a. The abrasive particles 24a of the sandpaper 18a form an abrasive layer 18a. Most of whatever rigidity the structural layer 20a possesses is possessed by the paper part 162 of the sandpaper; the substrate 158 in this case is quite flexible alone.

Figure 13:
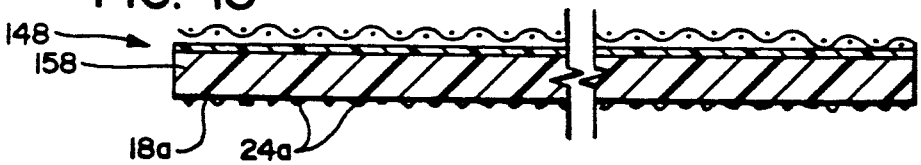
FIG. 13 is another cross section like FIG. 12 but showing a different composition of layers of the apparatus.

A variation of this configuration is shown in FIG. 13. Instead of employing the sandpaper with the abrasive particles 24a and paper part 162, the abrasive particles 24a alone are connected directly to the substrate 158. As an additional variation, the substrate 158 may be used alone after being treated in such a way as to have abrasive properties of its own. In these cases, the necessary resiliency of structural layer 20a is supplied by the substrate 158 alone.

The second embodiment 148 is normally made of materials that are disposable, but may, if such is the nature of the abrasive surface 26a, be made to be durable.

Figure 7A:
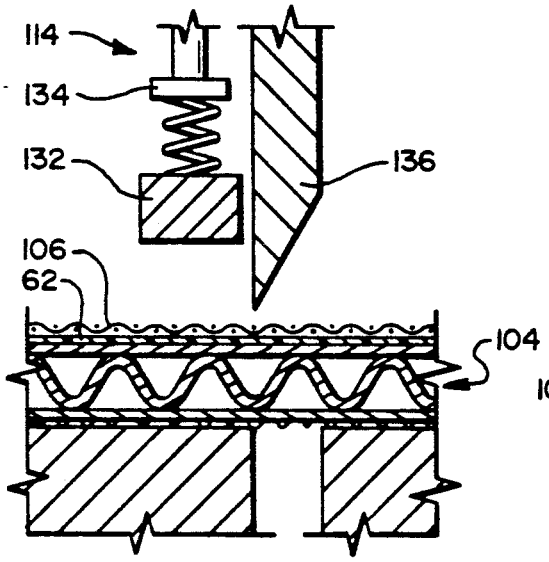
FIGS. 7*a, b* and *c* are schematic sideviews of the combination tool and laminated layers of the apparatus taken along the line 7—7 in FIGS. 6*a* and 6*b*; views *a,b* and *c* in FIG. 7 show the tools at progressive instants in operation.
Figure 7B:
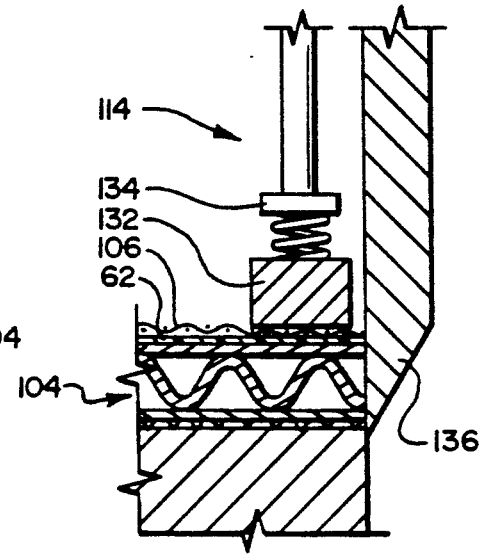
Figure 7C:
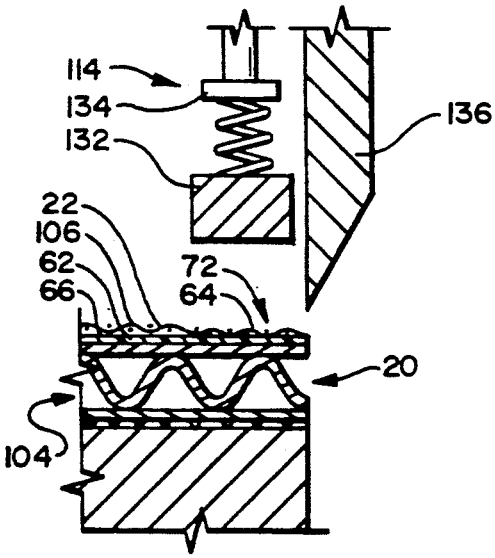
Figure 8A:
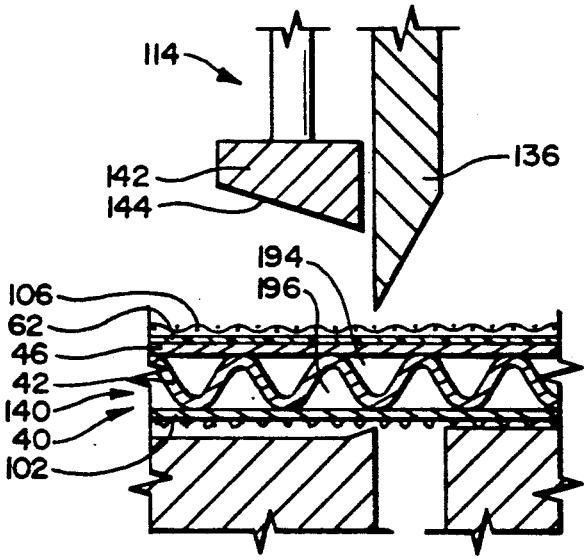
FIGS. 8*a, b* and *c* are views like FIG. 7 but taken along the lines 8—8 in FIGS. 6*a* and 6*b;*
Figure 8B:
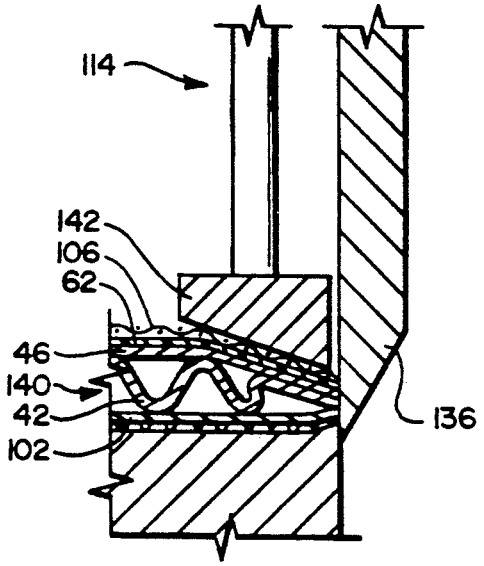
Figure 8C:
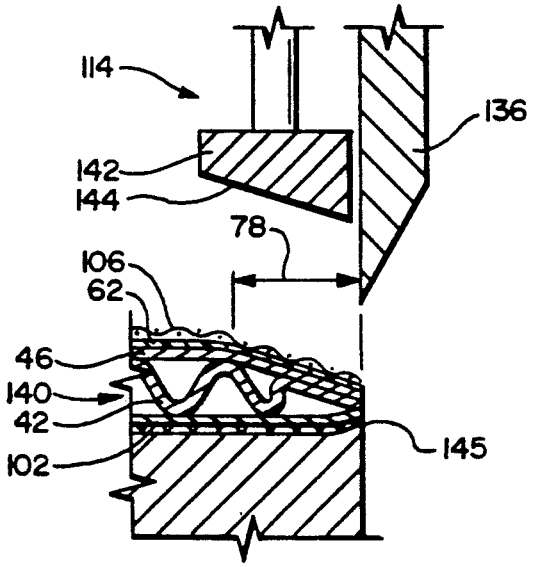
Figure 9:
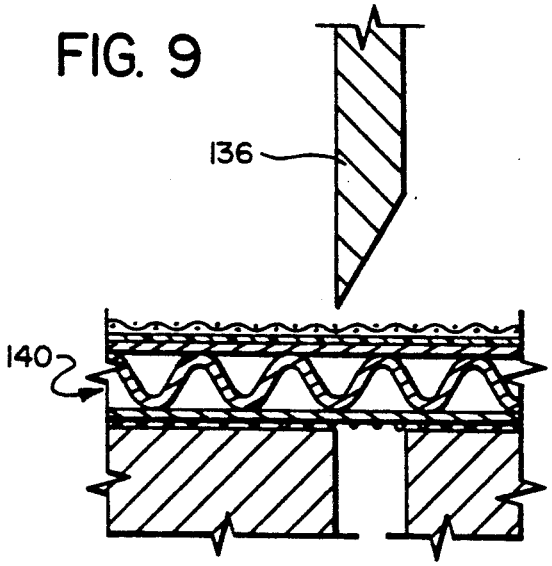
FIG. 9 is a view like FIGS. 7 and 8 but taken along the line 9—9 in FIG. 6*a;*
Figure 11:
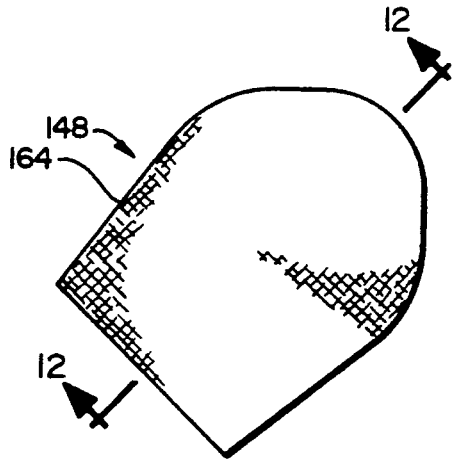
FIG. 11 is a top view of the second embodiment.

As shown in the top view of FIG. 11 the second embodiment 148 does not have the straight edges (70 and 72) or the corner (74) of the first embodiment but rather presents a flexible edge 164 all around its periphery. In manufacturing the second embodiment 148, the crushing step shown in FIG. 8a–c is simply omitted. Since the structure is inherently flexible, the entire periphery of the device will form the flexible edge 164. (The steps shown in FIGS. 7 and 9 are both used with second embodiment because the retaining layer 22a must be fastened to the structural layer 20a by remelting the hot-melt material 62a, and also the general cutting out of the device from the layered strips is required.)

Figure 14:
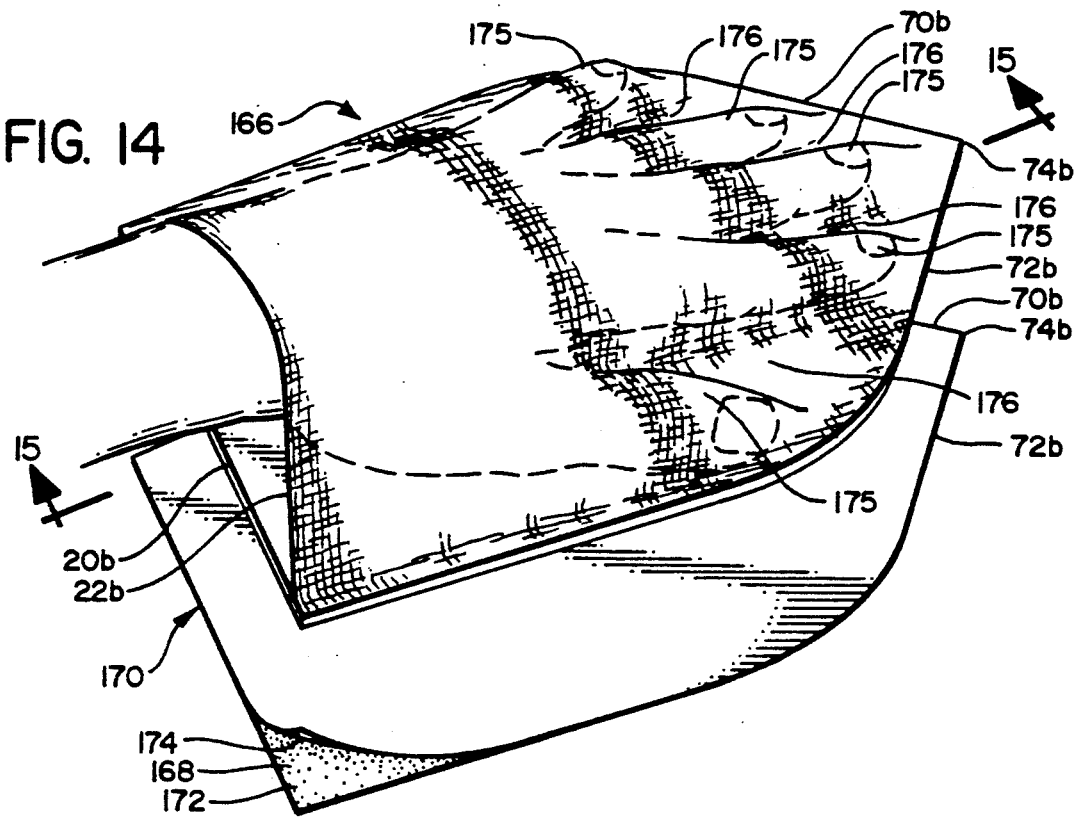
FIG. 14 is a perspective view of a third embodiment of the apparatus of the present invention.

5. A Third Embodiment-Reusable. FIG. 14 shows a third embodiment 166 in which components like those of the first embodiment will have the same numbers with the letter "b" added. The third embodiment 166 has the same components and features of the first embodiment, except that it is adapted for extended use. Also, there are both rigid and flexible versions of the third embodiment.

Figure 15:
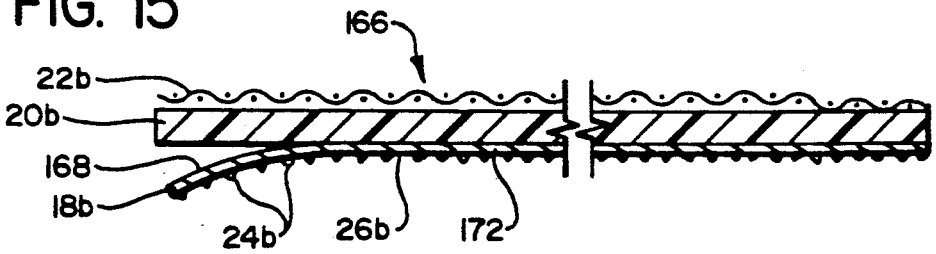
FIG. 15 is a cross section taken along the line 15—15 in FIG. 14.
Figure 15A:
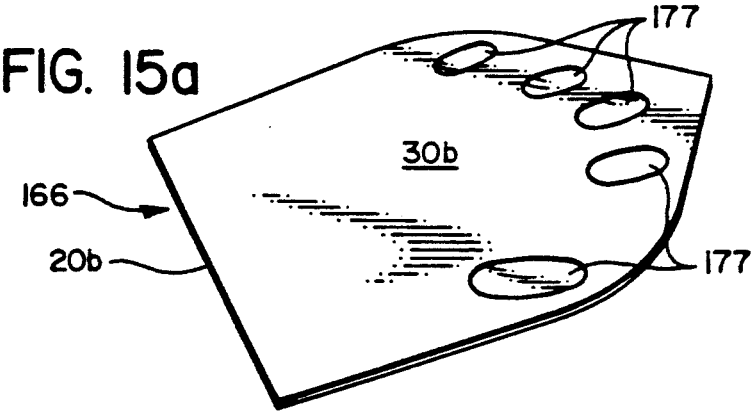
FIG. 15*a* shows a variation of the third embodiment illustrating in exposed perspective view the structural layer.

As shown in the cross-section of FIG. 15 the third embodiment 166 comprises a lower sandpaper layer 18b, a substrate layer 20b and a retaining layer 22b.

The sandpaper layer 18b and the substrate layer 22b have been modified compared to the first embodiment. The substrate 20b is of a more durable material than the material of the structural layer (20) of the first embodiment.

The sandpaper layer 18b is attached to the substrate 20b by means of a removable glue or adhesive 168. The sandpaper is available in the form of a pre-cut sandpaper sheet 170 shown in FIG. 14. The sandpaper sheet 170 comprises abrasive particles 24b to form a downwardly facing abrasive surface 20b, a paper part 172, the removeable adhesive 168, and a peelable cover 174. The peelable cover 174 covers the adhesive 168 so that precut sheets 170 are able to be handled and stored without touching or disturbing the adhesive 168. The peelable cover 174 contacts the adhesive 168 with a semi-adhering surface, so that the cover 174 is able to be readily peeled back to expose the adhesive 168, whereupon the sandpaper sheets 170 may be pressed by hand against the lower surface of the substrate layer 20b to become adhered thereto. To conform congruently with the bottom surface of the devices as shown in FIG. 14 the sandpaper sheet 170 has the tapered point configuration of the apparatus 166 including, in the illustrated embodiment, the straight edges 70b and 72b and corner 74b previously described. The size is such that the sandpaper sheet 170 is entirely congruent with the sanding apparatus 166 (If a different configuration of he sanding apparatus 166 were to be used, then the configuration of the sheet 70 would differ so as to match the apparatus 166.) The removeable glue 168 is pressure sensitive so that when downward pressure is applied on the substrate 20b, the sandpaper 18b becomes firmly attached to the substrate 20b. However, when the person wants to remove the sandpaper from the device after use, the person simply peels back the sandpaper starting at one edge thereof for easy removal.

Instead of the open pocket configuration pictured in the first embodiment, the third embodiment employs five fingerlets 175 which further enhance the retention of the device on the person's hand. The fingerlets 175 are defined between the structural layer 20b and the retaining layer 22b and are further defined by additional bonding of the retaining layer 72b to the structural layer 20b at intermediate locations 176 between the positions of the person's fingers. They are each adapted to receive one of the person's fingers. The fingerlet confifguration is able to be used with all the other embodiments herein. In a variation, an upper structural surface 30b of the substrate or structural layer 20b has five indentations 177 which are shaped to receive the tips of the person's fingers and thumb so as to further enhance gripping. The indentations 177 are formed by crushing or softening the upper structural surface 30b of the layer 20b. Like the fingerlets, the finger indentations 177 are also able to be used with all of the other embodiments herein.

To recapitulate, the principle feature added to the inventive apparatus by the third embodiment 166 is the reusability of the substrate 20b and retaining layer 22b. Such reusability enables more durable materials to be used in these layers.

Figure 16:
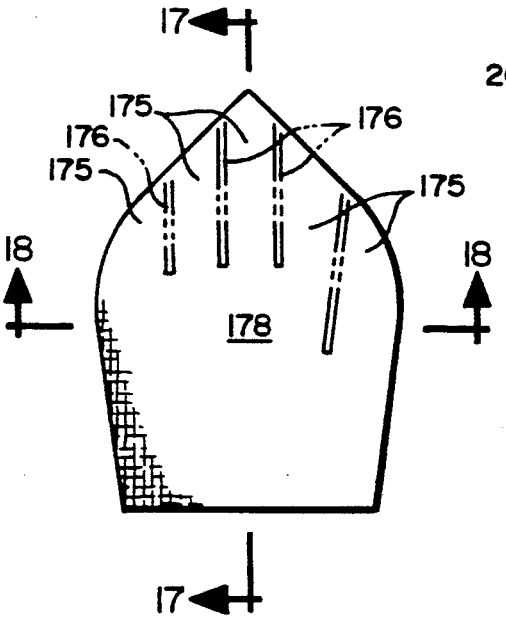
FIG. 16 is a top view of the third embodiment.
Figure 17:
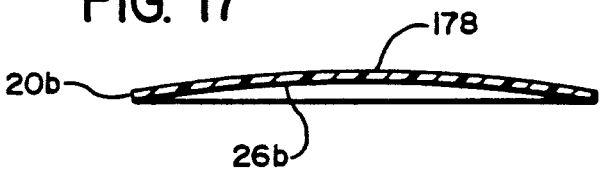
FIGS. 17 and 18 are cross sections from FIG. 16 taken along the lines 17—17 and 18—18, respectively.
Figure 18:
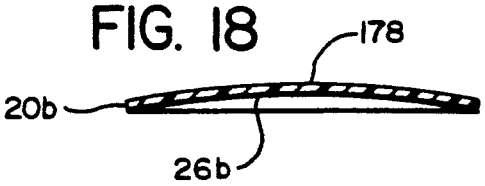

In a variation of the third embodiment based upon the durable nature of the substrate 20b shown in the top view FIG. 16 and cross-sections of FIGS. 17 and 18, the substrate 20b is formed to have a small natural camber while maintaining some resiliency. In the absence of force exerted by the person's hand, the apparatus assumes an upwardly deflected position shown in FIG. 17. When the person exerts a downward force, the device then flattens to the planar position shown in FIG. 16. (This action also occurs transversely as indicated in FIG. 18.) Consequently, the apparatus exerts a natural springing action, so that when the person applies the force on a central crown area 178 this force is distributed uniformly by the substrate to the entire abrasive surface 26b.

A flexible variation of the third embodiment 166 employs the replaceable sandpaper layer described, but has flexibility along one or more of its axes by dispensing with the rigidity of the structural layer 20b. Instead, in the manner of the second embodiment a less rigid substrate is used in the layer 20b which enables the device to be effectively used on simple curves and complex curved work surfaces.

6. Fourth Embodiment-Automotive Version. A fourth embodiment 180 of FIG. 19 wherein components similar to those of the earlier embodiments receive the same numbers with "c" added, is the same as the third embodiment except that the fourth embodiment 180 is adapted for use with automotive or marine surfaces such as painted metal or fiberglass. The primary modification in the fourth embodiment 180 is that the apparatus is water immersible. Like the third embodiment, there are both flexible and rigid versions.

Figure 19:
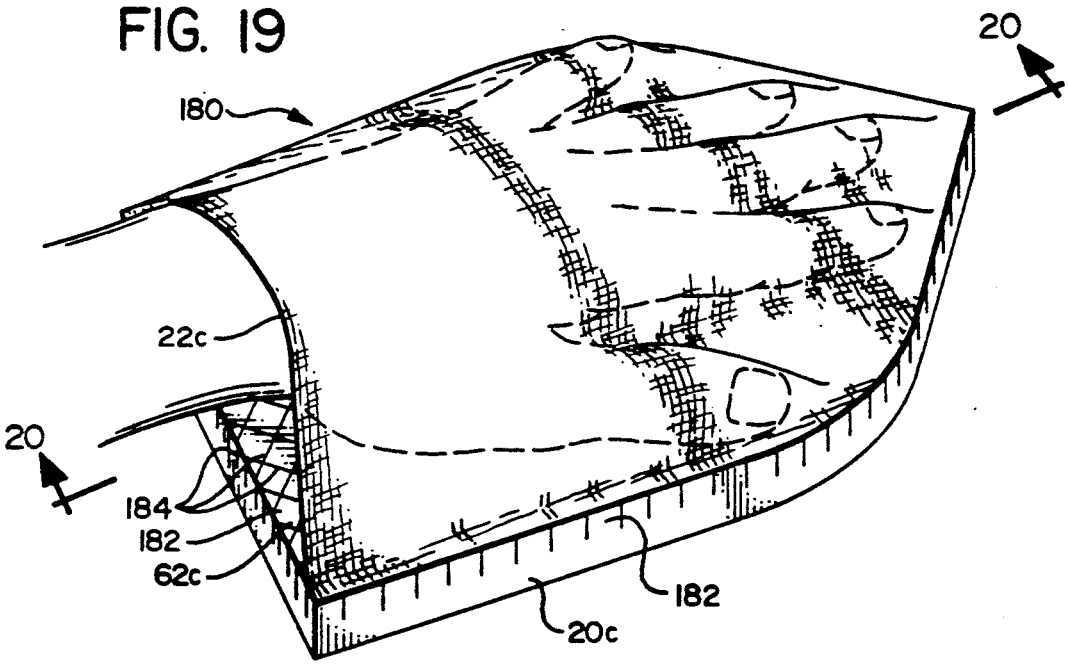
FIG. 19 is a perspective view of a fourth embodiment of the apparatus of the present invention.
Figure 20:
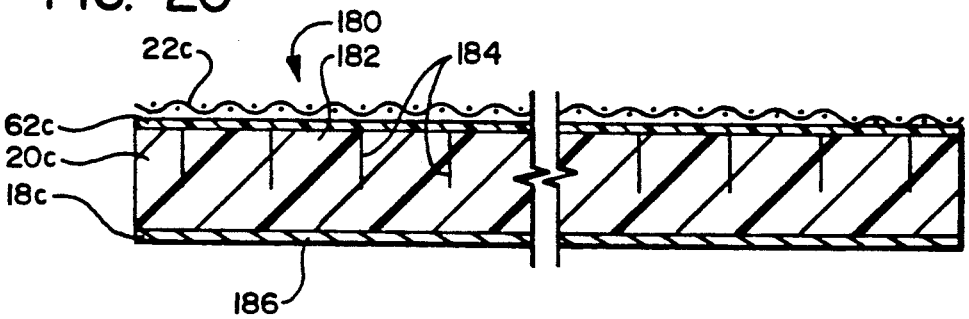
FIG. 20 is a cross section taken from FIG. 19 along the line 20—20.

As shown in FIG. 19 the fourth embodiment 180 comprises an abrasive layer 18c a substrate 20c and a retaining layer 22c. The substrate 20c in this case is of a cellular, corrugated, or solid material which is unharmed by water immersion. The abrasive layer 18c which is made of silicon carbide particles or other abrasive coating is also water immersible. All of the other components, i.e., the retaining layer 22c, the hot-melt material 62c, are water immersible.

In the flexible version of the fourth embodiment the top portion 182 of the substrate 20c may have a series of parallel cuts 184 therein to produce a scoring pattern. The cuts 184 intersect at right angles. Such scoring of the upper portion 182 facilitates curving of the flexible version as in FIG. 10. The substrate 20c is pictured as thicker than in the earlier embodiment; however, such increased thickness is not required where a thinner substrate 20c would have sufficient water resistant properties. Some types of sandpaper 18c having a paper part 186 are sufficiently resistant to water alone so that no further substrate is required. In this situation, the paper part 186 with the abrasive underneath is simply bonded to the retaining layer 22c using the hot-melt material 62c.

Additionally, in the fourth embodiment 180, which as mentioned is directed at automotive sanding, there is an alternative to making the apparatus to be water immersible. An alternative version is to employ substantially the earlier embodiments but with the abrasive layer 18c adapted to shed, or easily slough off, the sanded powder that results from sanding the painted metal surfaces. The abrasive layer is simply treated with an agent such as magnesium or calcium stearate that enhances such shedding.

7. Further Technical Details.

Further technical details are now provided concerning the apparatus and manufacture.

a. Details of the Apparatus. The rigid versions of the apparatus nonetheless allow for some bending in the structure. Bending is able to be favored either parallel to the lengthwise axis or parallel to the crosswise axis. In the versions that have the rigid corner (74 in the first embodiment) a bend axis parallel to the lengthwise axis enhances the rigidity of the corner and of the straight edges (70 and 72 in the first embodiment). On the hand a bend axis which is parallel to the crosswise axis provides some advantages, including a bend that conforms more naturally to the person's natural hand movement. In the first embodiment using the corrugated substrate layer, the bend axis will depend upon the orientation Of the length of the corrugations 42 (FIG. 3). The length of the corrugations 42 may be parallel to the lengthwise axis 92 if enhanced rigidity of the forward end of the apparatus is desired, while the corrugations 42 may be oriented crosswise in circumstances where bend along that axis is preferred.

Let us briefly describe the dimensions of the illustrated embodiments. The first embodiment shown in the plan view of FIG. 2 will be used to illustrate the dimensions, but these are equally applicable to the other embodiments. The apparatus is semetric along a lengthwise axis. The base 54 is 5 to6' long. The distance from each of left and right corners 190 and 192, respectively, to the locations 59 and 60 where the outline curves, is 5½' to 6'. The distance from the points 59 and 60 to the corner 74 is 4½' to 5'. The illustrated thicknesses in the first embodiment are 0.01–0.03 inches for the sandpaper, ⅛ inch for the corrugated substrate 20, and about 0.01–0.03 inches for the retaining layer 22. The thickness of the substrate in the other embodiments is ⅛ inch in the second embodiment, 0.05 inches in the third embodiment and ¾ inches in the fourth embodiment.

b. Details of Manufacture. Further details concerning manufacture will now be given.

In the crushing step of FIG. 8a–c, an alternative is to apply or inject an adhesive at 194 between the outer margin of the corrugations 42 and the upper sublayer 46, and at 196 between the corrugations 42 and the sandpaper 102.

The hot melt material 62 is able to be applied only at selected spots on the upper surface 28 where adhesion between the upper surface 28 and the person's hand is needed. The use of the hot melt material 72 to form the semi-adhesive surface 66 is able to be eliminated altogether, saving the hot melt material 62 only for formation of the fastening strips 64.

It is preferable that adhesives having no solvents (i.e. nonwater based media) be used in manufacture. An advantage of the hot melt material 62 is that no solvents are required. Preferably the adhesive applied at 120 in FIG. 4 uses no solvents. An advantage of using a corrugated paper 104 in manufacturing along with sandpaper 102 is that these materials will absorb in water readily and a waterbased adhesive, such as polyvinyl acetate, is able to be used at 120.

A preferred material to form the retaining layer in all of the embodiments is a web or fabric marketed by Dupont Nemours & Co. under the trademark "SONTARA", in as much as this is a breathable light fabric that stretches across one axis.

There are specific considerations in manufacturing the apparatus so that the axis of stretch of retaining layer and the axis of bending of the structural layer are properly related to one another. The first embodiment will be used for illustration of this point, but it is applicable to the other embodiments as well. Viewing FIG. 1, it is evident that the retaining layer should stretch across the lengthwise axis of the apparatus so that the retaining layer 22 may deflect upwardly when the hand is inserted into the hand receiving area. The "axis of stretch" of the retaining layer is the axis across which the fabric stretches. At least two versions are possible. First, the axis of stretch of the retaining layer is parallel to the bending axis of the structural layer. In manufacturing as shown in FIG. 4, let us assume that the corrugated material 104 is used, in which case the axis of bend in the material 104 will be transverse to the direction of feed. Let us assume now that the material in the strip 106, such as the SONTARA is packaged in the rolls 100 in a manner that the stretch axis of the strip 106 is transverse to the direction of feed. In this case the installation 94 shown in FIG. 4 will properly align the bending axis with the stretch axis But let us examine this second situation where it is desired to have the stretch axis at right angles to the bend axis. In this case, the installation 94 is altered so that the direction of feed of the material 106 is need to be transverse to the direction of feed of the other two strips 102 and 104. The strip 106 would simply feed at right angles to the other strips into the cutting-pressing location 110. The end result would be an apparatus with the axis of stretch perpendicular to the axis of bends.

It is to be understood that the basic concepts of feeding the different layers from three rolls into common joining and cutting locations shown in the first embodiment is equally applicable to all the other embodiments, even where rigid materials are involved, provided that the circumstances are such that the materials can be stored on rolls. The abrasive layer in certain circumstances may be sprayed or coated on the substrate layer.

There is further modifications Of the foregoing described embodiments are feasible within the scope of the present invention. Particular features that are applicable to any one of the embodiments, may be utilized in various combinations with the other embodiments.

What is claimed is:

1. An apparatus for abrading a work surface, comprising:

a. an abrasive layer having a first surface and a second, abrasive surface;

b. a structural layer having a third surface and a fourth surface, where the first surface is attached to the third surface; and c. a retaining layer that resiliently extends along an axis of stretch, where the retaining layer is so attached to the fourth surface that a hand may be inserted between the structural layer and the retaining layer;

whereby the retaining layer stretches along its axis of stretch to allow the abrasive and structural layers: (i) to remain substantially planar while a planar portion of the work surface is being abraded; and (ii) to bend such that the abrasive surface conforms to an outwardly curved portion of the work surface.

2. An apparatus as recited in claim 1, in which the apparatus has a lengthwise axis and a cross-wise axis, the lengthwise axis being substantially parallel to the fingers of the hand and the cross-wise axis being substantially transverse to the lengthwise axis, where the retaining layer stretches to allow the abrasive and structural layers to bend about an axis substantially parallel to the cross-wise axis.

3. An apparatus as recited in claim 1, in which the retaining layer is not attached to a portion of each side of the apparatus.

4. An apparatus as recited in claim 1, in which the structural layer comprises at least one of a group of materials consisting of open cell polymer foam and closed cell polymer foam.

5. An apparatus as recited in claim 2, in which the structural layer comprises a planar layer and a fluted layer, where the flutes in the fluted layer are arranged parallel to the cross-wise axis, the third surface of the structural layer is comprised of the flutes of the fluted layer, and the planar layer defines the fourth surface of the structural layer.

6. An apparatus as recited in claim 5, further comprising an adhesive layer formed on the planar layer of the structural layer, where the adhesive layer comprises a hot-melt adhesive material that is:

a. melted along a portion of the periphery of the structural layer to bond the retaining layer to the structural layer; and b. not melted on the remaining portion of the structural layer to provide a surface that enhances retention of the hand within the apparatus during sanding.

7. An apparatus as described in claim 1, wherein an end of the apparatus adjacent to the fingers of the hand comprises edges that converge to form a corner, whereby said apparatus may be used conveniently to sand a corner region of the work surface.

8. An apparatus for abrading a work surface, comprising:

a. a substantially planar abrading layer having an abrasive surface and a non-abrasive surface;

b. a structural layer having i. a first surface adapted to frictionally engage a hand so that, when the hand applies an abrading force having components directed towards and parallel to the first planar surface, relative movement between the hand and the first planar surface in any direction parallel to the first planar surface is substantially prevented, and ii. a second surface attached to the non-abrasive surface of the abrading layer, where, when the hand applies the abrading force to the work surface through the structural and abrading layers, the abrasive surface to abrade the work surface; and c. a retaining layer formed from material that resiliently extends along a stretch axis and is attached along a substantial portion of the periphery of the first surface of the structural layer, where the retaining layer is so attached to the structural layer that the hand may be inserted into a pocket formed between the structural layer and the retaining layer;

whereby the hand is received within the pocket such that the abarding force may be applied to the first surface by the entire hand.

9. An apparatus as recited in claim 8, in which the retaining layer is not attached to a portion of each side of the apparatus.

10. An apparatus as recited in claim 8, in which the retaining layer stretches along its axis of stretch to allow the abrasive and structural layers to remain substantially planar while a planar portion of the work surface is being abraded and to bend such that the abrasive surface conforms to an outwardly curved portion of the work surface.

11. An apparatus as recited in claim 8, in which the apparatus has a lengthwise axis and a cross-wise axis, the lengthwise axis being substantially parallel to the fingers of the hand and the cross-wise axis being substantially transverse to the lengthwise axis, where the retaining layer stretches to allow the abrasive and structural layers to bend about an axis substantially parallel to the cross-wise axis.

12. An apparatus as recited in claim 8, in which the structural layer comprises at least one of a group of materials consisting of open cell polymer foam and closed cell polymer foam.

13. An apparatus as recited in claim 8, in which the structural layer comprises a planar layer and a fluted layer, where the flutes in the fluted layer are arranged parallel to the cross-wise axis, the second surface of the structural layer is comprised of the flutes in the fluted layer, and the planar layer defines the first surface of the structural layer.

14. An apparatus as recited in claim 13, further comprising an adhesive layer formed on the planar layer of the structural layer, where the adhesive layer comprises a hot-melt adhesive material that is:

a. melted along a portion of the periphery of the first surface to bond the retaining layer to the structural layer; and b. not melted on the remaining portion of the first surface to enhance the ability of the first surface to frictionally engage the hand.

15. An apparatus as described in claim 8, wherein an end of the apparatus adjacent to the fingers of the hand comprises edges that converge to form a corner, whereby said apparatus may be used conveniently to sand a corner region of the work surface.

* * * * *